United States Patent [19]

Harada

[11] Patent Number: 4,762,314

[45] Date of Patent: Aug. 9, 1988

[54] ENVELOPE FEEDER

[76] Inventor: Hiroshi Harada, 2-4-44, Kamiashiarai, Shizuoka-shi, Shizuoka-ken 420, Japan

[21] Appl. No.: 63,127

[22] Filed: Jun. 17, 1987

[51] Int. Cl.[4] ..... B65H 5/12

[52] U.S. Cl. ..... 271/267; 271/151; 271/3.1; 271/274; 271/212

[58] Field of Search ..... 271/151, 37, 38, 3.1, 271/267, 274, 273, 272, 212

[56] References Cited

U.S. PATENT DOCUMENTS 2,097,013 10/1937 Bartholdt ..... 271/37
4,369,959 1/1983 Hornbuckle ..... 271/3.1

FOREIGN PATENT DOCUMENTS 58-78842 5/1983 Japan .

*Primary Examiner*—Joseph J. Rolla
*Assistant Examiner*—Stephen Parker
*Attorney, Agent, or Firm*—C. O. Marshall, Jr.

[57] ABSTRACT

Envelopes are fed in a mutually overlapping state one by one toward a stopper provided at the front side of a transfer conveyor. Upon abutment with the stopper the envelopes pile up so as to be temporarily stored. An envelope feeder device is provided so as to enable a large number of envelopes to pile up. The envelope feeder device includes a body which is adjustably supported from a support shaft above the transfer conveyor, so as to position the feeder device according to the size of the envelopes. A pair of first rollers are mounted to both sides of the body and positioned so as to roll upon the upper surface of the transfer conveyor. Each first roller includes a rotary member mounted eccentrically on its side. A bifurcated feed member engages with the eccentric rotatable members so as to reciprocate horizontally as by the rotational movement of the first rollers, whereby assisting in the piling up of the envelopes as by a pair of claws located at the free ends of the bifurcated portions. Also, a bifurcated support member with a second pair of rollers located at the free ends thereof is fixed pivotally to the body and provided with a spring so as to constantly urge the second rollers toward the upper surface of the transfer conveyor.

1 Claim, 5 Drawing Sheets

ENVELOPE FEEDER

BACKGROUND OF THE INVENTION

1. Field of the Invention

This invention relates to an attachment to an envelope feed machine used to feed envelopes continuously to a printer, and more particularly to an envelope feeder for driving envelopes one by one so as to feed them to a temporary storage station which is located just under an air sucker in a stream feeder type printer.

2. Description of the Prior Art

An envelope has folded, overlapped and pasted portions, i.e., it does not have a uniform thickness. Therefore, when a plurality of envelopes are stacked before they have been fed to a printing position, they are inclined. Accordingly, only several hundred envelopes at most can be stacked directly on a paper feeder for a printer, and, moreover, it is impossible to expect that these envelopes be kept stable on the paper feeder. Interrupting a printing operation every time several hundred envelopes have finished being printed causes the operation efficiency to decrease to an extremely low level. In order to prevent this inconvenience, such a system is generally employed that a special envelope feeder is connected to the paper feeder for a printer so as to store a suitable number of envelopes successively in piled state just under an air sucker for the paper feeder.

There is U.S. Pat. No. 4,369,959 disclosing such a type of envelope feeder which is roughly constructed as follows. A plurality of envelopes are piled in inclined state in a stack formed of a frame, and the piled envelopes are stripped one by one from the bottom of the stack and sent out by a diagonal conveyor. The envelopes are then inverted by an inversion conveyor which contacts the diagonal conveyor, and thereafter transferred in successively overlapped state by a horizontal transfer conveyor. The downstream end of the transfer conveyor is joined directly to the portion of a printer which is just under an air sucker of a paper feeder for the printer. The envelopes transferred successively in overlapped state are then piled up in several layers in a bottom layer-lifting manner on the downstream end portion of the transfer conveyor and stored in the same position temporarily to stand by ready to be picked up by the air sucker.

In order to pile up envelopes in a bottom layer-lifting manner in a position just under the air sucker, the purpose is not met if the envelopes which have been sent thereto in mutually overlapped state along the surface of the transfer conveyor are merely forwarded as they are. It is necessary to drive the overlapped envelopes one by one toward a stopper provided at the front side of the transfer conveyor, and pile them up with the front ends of the envelopes aligned by this stopper.

It is a feeder that is added to an envelope feed apparatus for this purpose. The techniques relative to the feeder include, for example, those disclosed in Japanese Utility Model Laid-Open No. 78842/1983. These techniques are directed to an auxiliary transfer structure in which a holding roller is connected rotatably to the lower end portion of a support arm extending above a transfer conveyor, support shafts being provided so as to project from the outer side of the support shaft and the outer circumferential portion of the holding roller, respectively, the support shaft for the support arm being engaged with a horizontally-elongated guide bore made in the rear portion of a drive plate, the support shaft for the holding roller being engaged with a vertically-elongated bore made in the front portion of the drive plate.

However, since two support shafts are engaged with horizontally- and vertically-elongated guide bores, respectively, in this prior art transfer structure, the actions of the parts are not smoothly made, and the feed power is small, the reliability of the operation being low.

In order that the envelopes can be printed with a specially high efficiency, a stream feeder type printer having a high printing rate or a high feed rate is used. In such a printer, the rear end of each envelope is dealt with by an air sucker, and the envelopes are arrayed in a scalelike configuration, i.e., in continuously-overlapped state on a feeder board and fed to a printer body.

In order to prepare envelopes for the purpose of being printed properly by such a stream feeder printer, it is necessary that the largest possible number of envelopes be piled up in very good order and in a reliable manner in a storage station just under the air sucker. Accordingly, it is also necessary, of course, that a feeder is moved smoothly and has a large feed power. If an erroneous operation, in which the feeder runs on an envelope which is being piled on another, occurs, the performance of the stream feeder type printer cannot be effectively utilized, so that such an erroneous operation is in no case allowed.

SUMMARY OF THE INVENTION

The present invention has been developed so as to solve the above-mentioned problems, and provides an advanced envelope feeder. A primary object of the present invention is to carry out an envelope-feeding operation reliably, and prevent an erroneous operation, in which an envelope feeder runs on an envelope which is being piled on another, of the envelope feeder.

Another object of the present invention is to provide an envelope feeder capable of being operated smoothly, and having large feed power.

To achieve these objects, the feeder according to the present invention is provided with a basic body which is suspended from a support shaft provided above a transfer conveyor for the envelope feeder, and which extends along the transfer conveyor, a pair of first rollers fixed rotatably to both sides of the substantially central portion of the basic body and having eccentric rotary members at the side portions thereof, a feed member engaged with the basic body so that the feed member can be reciprocatingly moved, having claws at the free ends of a bifurcated portion thereof, and engaged at the rear portion thereof with the eccentric rotary members, and a roller support member having at the free ends of a bifurcated portion thereof a pair of second rollers disposed in parallel with the claws, fixed pivotably at the substantially central portion thereof to the basic body, and urged constantly at the second rollers toward the surface of the transfer conveyor by a spring provided at the rear end portion of the support member.

In the envelope feeder according to the present invention, especially, the second rollers at the free ends of the roller support member are provided independently of the first rollers on the basic body and urged constantly and resiliently toward the surface of the transfer conveyor. Therefore, the envelope feeder does not run on an envelope which is being piled on another. This enables the functions of the claws, which are disposed in parallel with the second rollers, at the free ends of the feed member to be more profitably utilized, and an envelope to be sent smoothly under a preceding envelope. Consequently, a large number of envelopes can be stacked in order in the storage station just under the air sucker, and this enables the envelope feeder according to this invention to be adapted excellently to a high-speed printing operation of a stream feeder type printer.

The above and other objects of the present invention will become apparent from the following description of the preferred embodiment taken in conjunction with the accompanying drawings. These drawings illustrate only an embodiment of the present invention, and the present invention is not limited to this embodiment.

DESCRIPTION OF THE PREFERRED EMBODIMENT

Figure 1:
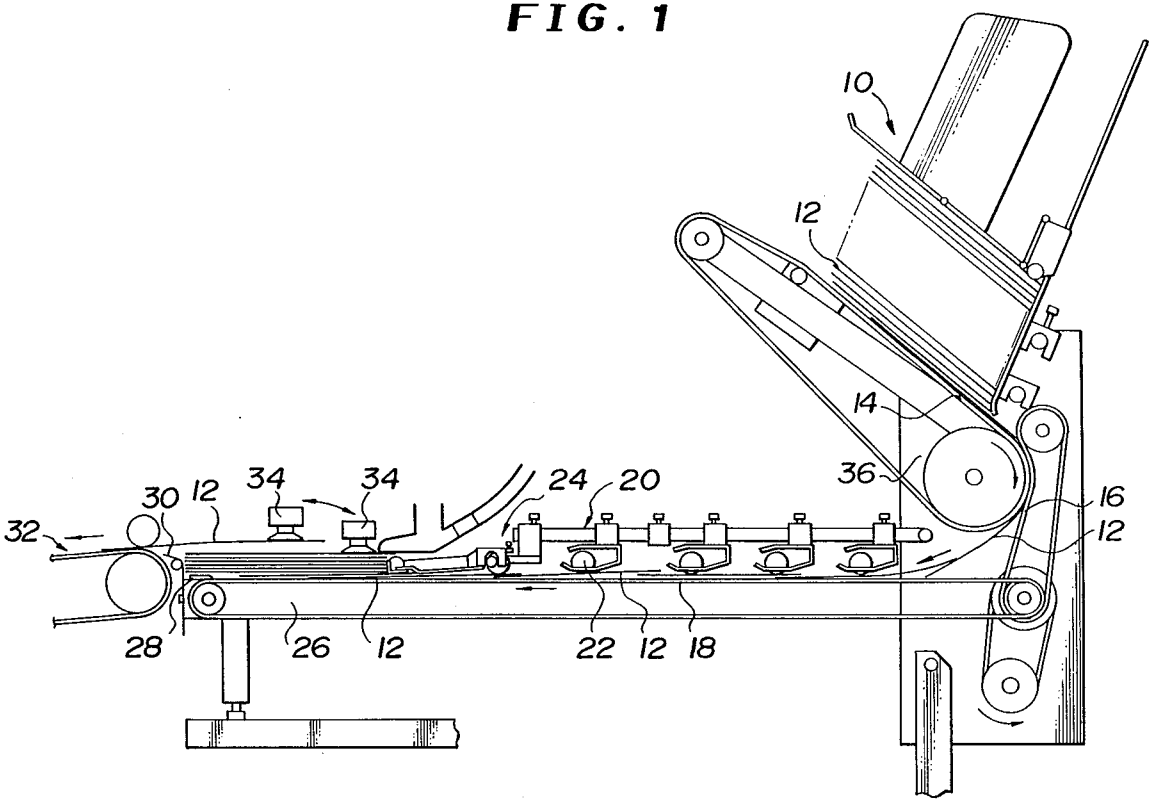
FIG. 1 is a general schematic diagram in side elevation of an envelope feed apparatus provided with an envelope feeder according to the present invention.

First, an envelope feed apparatus which the feeder according to the present invention serves will be roughly described with reference to FIG. 1. A plurality of envelopes 12 are piled up in an envelope stack 10 formed of an inclined frame. A diagonal conveyor 14 contacts the lowermost envelope 12, so that the envelopes are sent out successively from the lowermost envelope 12. An inversion conveyor 16 contacts the lower portion of the diagonal conveyor 14. Accordingly, the envelope 12 is sandwiched between and inverted by these conveyors 14, 16, and thereafter moved onto a horizontal transfer conveyor 18. This transfer conveyor 18 constitutes a section in which the envelopes 12 are arrayed successively in mutually overlapped state. Means for guiding the envelopes 12, which consists of guide balls 22 suspended from a support shaft 20, and a feeder (designated generally by a reference numeral 24) according to the present invention are provided on the upper side of the upper surface of the transfer conveyor 18.

At an end portion of a transfer table 26 around which the transfer conveyor 18 is wrapped, guide members 28 for the envelopes 12 and a stopper 30 are provided so that several envelopes 12 are piled up in a bottom layer-lifting manner and stored in the same position temporarily. Above these guide members 28, an air sucker 34 of a paper feeder (designated generally by a reference numeral 32) for a stream feeder type printer (not shown) is positioned, and the uppermost envelope 12 is adsorbed to the air sucker 34 to be sent to the paper feeder 32 or printer.

Figure 2:
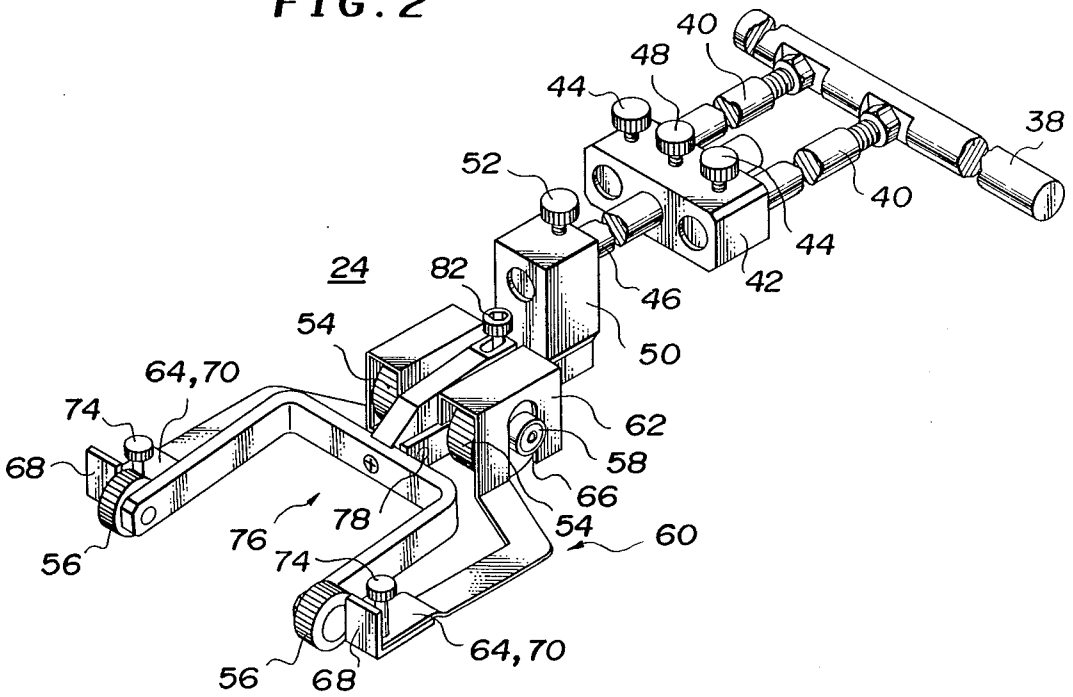
FIG. 2 is a perspective view of an embodiment of the feeder according to the present invention.
Figure 3:
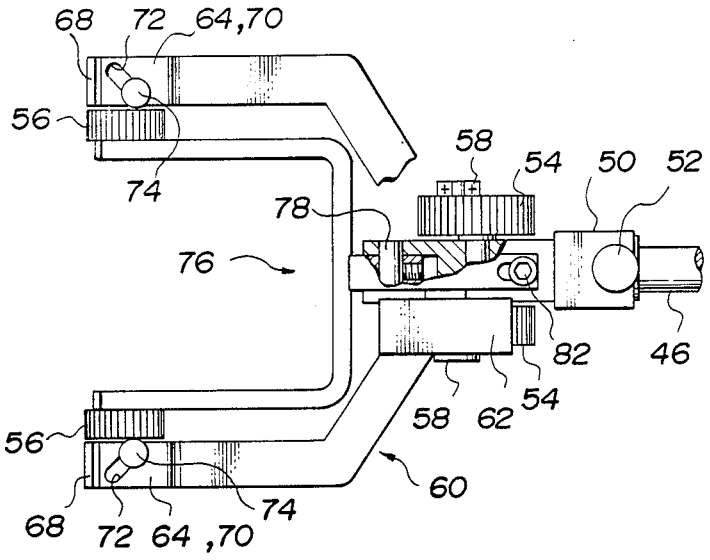
FIG. 3 is a plan view of the embodiment.

In the feeder according to the present invention which serves the above-described envelope feed apparatus, the envelopes sent in mutually-overlapped state by the transfer conveyor are driven toward a stopper 30 so as to be aligned and stored just under the air sucker 34. The construction of this feeder is as shown in FIG. 2.

The support shaft (designated generally by a reference numeral 20) fixed above the transfer conveyor 18 consists of a complex assembly as shown in the drawing, which is made expansible and contractible in the lengthwise direction of the transfer conveyor 18. To be concrete, two parallel longitudinal shafts 40 are joined to a lateral shaft 38 fixed to a side wall 36 of the envelope feed apparatus, and a slidable and fixable joint block 42 is secured by screws 44 to the front end portions of these longitudinal shafts 40. Another longitudinal shaft 46 is joined slidably and fixably to this joint block 42 and secured thereto by a screw 48. A basic body of the feeder according to the present invention is secured by a screw 52 to the front end of this longitudinal shaft 46. The reasons why the support shaft 20 is formed of a complex assembly reside in that the feeder according to the present invention on the transfer conveyor 18 is moved forward or backward in accordance with the size of the envelope 12 to be sent out, to enable the envelopes 12 to be piled up in an optimum position.

The basic body 50 suspended from the support shaft 20 is so to speak a chassis extending in the moving direction of the transfer conveyor 18, and consists of a substantially L-shaped body composed of a suspended portion and a principal portion crank-connected to the suspended portion so as to extend at right angles thereto.

A pair of first rollers 54 are fixed rotatably to both sides of the substantially central portion of the basic body 50. The diameter of the first rollers 54 is larger than that of second rollers 56 which will be described later, and the outer circumferential surfaces of the first rollers 54 are knurled. These first rollers 54 hold the envelope 12 on the transfer conveyor 18 while supporting the envelope 12 on the conveyor 18 stably.

Each of the first rollers 54 is provided on its outer side portion with an eccentric rotary member 58 the center of which deviates from that of the relative first roller 54. This eccentric rotary member 58 consists preferably of a roller bearing, and is formed so that, when the relative first roller 54 receives a frictional force from the transfer conveyor 18, the eccentric rotary member 58 turns around the center of the first roller 54, the eccentric rotary member 58 being permitted to turn around its own axis as well during this time.

A feed member 60, which is formed by bending a plate material, consists of a locking portions 62, which are engaged with the eccentric rotary members 58 so as to receive a force for moving the feed member 60 forward or backward, and claws 64 formed of a bifurcated body and having practical envelope-feeding functions. Each locking portion 62 is provided with a substantially vertical recess 66 which extends at right angles to the moving direction (i.e. the direction in which the longitudinal end surfaces of the basic body 50 face) of the feed member 60, and the eccentric rotary member 58 is fitted in this recess 66. Accordingly, when the first rollers 54 are rotated by the frictional force from the transfer conveyor 18 to cause the eccentric rotary members 58 to be turned around the centers of the first rollers 54, the feed member 60 is moved forward or backward by a distance which is twice as large as the quantity of deviation of each eccentric rotary member 58 since the feed member 60 is allowed to move only in the direction parallel to the side surfaces of the basic body 50. If the eccentric rotary member 58 consist of roller bearings, they can turn around the centers of the first rollers 54 as well as their own axes, so that the transmission between the eccentric rotary members 58 and recesses 66 of the force for driving the feed member 60 forward or backward can be carried out smoothly with the feed stroke of the feed member 60 becoming smooth.

The claws 64 of a bifurcated body are adapted to drive the envelope 12 forward on the basis of the reciprocating movements mentioned above of the feed member 60. The claws 64 may consist of two members which merely extend in parallel with the basic body 50. There is an envelope having an inclined side end portion. In order that such a type of envelope can also be driven smoothly, the claws 64 are formed so that an opening angle of the claws 64 can be varied in accordance with the type of the envelope to be fed. Namely, each claw 64 is divided into a tip portion 68 and a base portion 70, and the base portion 70 is provided with a curved bore 72. The opening angle of each tip portion 68 is varied in accordance with the type of the envelope 12, and the tip portion 68 is fixed by a set screw 74. The two claws 64 of a bifurcated body and locking portions 62 are, of course, connected to each other between the basic body 50 and a roller support member 76.

Figure 7:
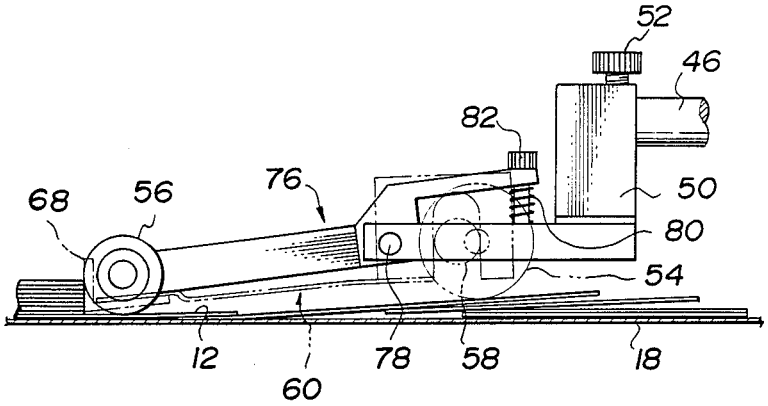
FIG. 7 is a side elevational view illustrating an operation of the embodiment.

The roller support member 76 is joined pivotably at the substantially central portion thereof to the front end portion of the basic body 50 by a pin 78. The front end portion of the roller support member 76 is bifurcated in the same manner as the body of the claws 64 of the feed member 60, and a pair of second rollers 56, which are positioned in parallel with the claws 64, are fixed to the front end portions of the bifurcated portion of the support member 76. The outer circumferential surfaces of the second rollers 56 are also knurled. As shown in FIG. 7, the second rollers 56 cooperate with the claws 64 of the feed member 60 in pressing the foremost envelope 12 out of the envelopes 12, which are sent forth in a mutually overlapped state by the transfer conveyor 18, against the surface of the same conveyor 18 firmly by the resilient force of a spring, which will be described later, and driving the same envelope 12 beneath the lowermost envelope 12 of a plurality of piled envelopes 12.

In order to urge the second rollers 56 constantly toward the surface of the transfer conveyor 18, a spring 80 is wound around a guide bolt 82 provided vertically on the portion of the basic body 50 which is at the rear end of the roller support member 76. The second rollers 56 are urged resiliently by the spring 80 via the pin 78 as a fulcrum.

In the envelope feeder according to the present invention, attention should be paid to the following points. The first rollers 54 used to primarily cause the feed member 60 to be moved forward and backward, and the second rollers 56 used to press the envelope 12, which is immediately before the piled envelopes 12, and drive the envelope 12 beneath the lowermost envelope 12 of the piled envelopes 12 are supported independently of each other, and, moreover, the second rollers 56 are urged constantly toward the surface of the transfer conveyor 18 by the spring 80. Therefore, the second rollers 56 do not run on the piled envelopes 12, and the foremost envelope 12 is driven successively and reliably beneath the lowermost envelope of the piled envelopes 12. The present invention can suitably be used for a stream feeder type printer, and is capable of piling a large number of envelopes 12 reliably just under the air sucker 34.

The operation of the present invention will now be described. The envelopes 12 sent in successively overlapped state by the transfer conveyor 18 advance as they are held by the first rollers 54 and then second rollers 56.

Figure 4:
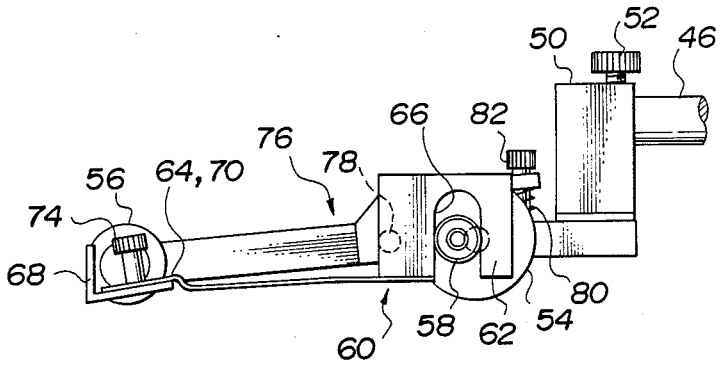
FIG. 4 is a side elevational view of the embodiment.
Figure 5:
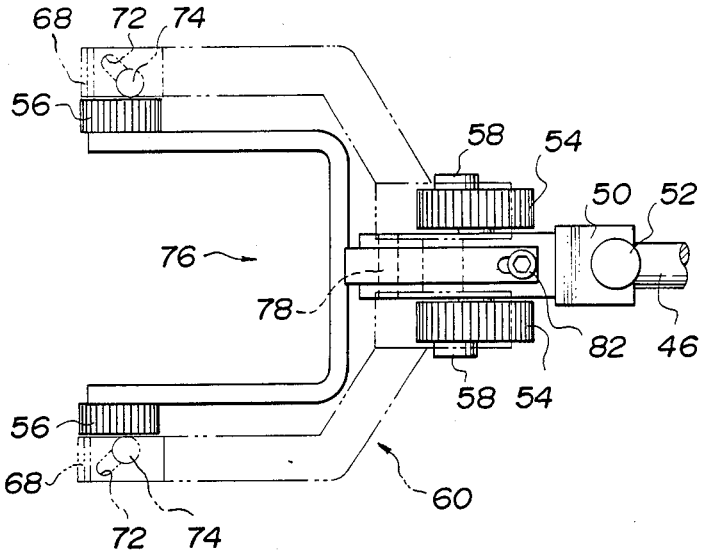
FIG. 5 is a plan view of the embodiment with a feed member omitted.
Figure 6:
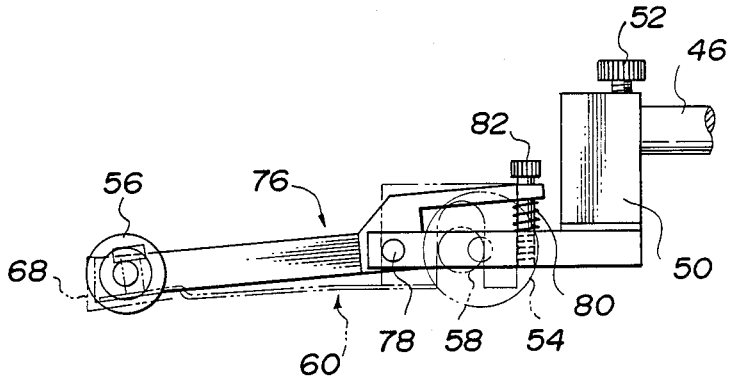
FIG. 6 is a side elevational view of what is shown in FIG. 6.

The first rollers 54 receive a rotational force, which is caused by the friction between the rollers 54 and transfer conveyor 18, from the same conveyor 18, and are turned clockwise in FIG. 4.

When the eccentric rotary member 58 in FIG. 4 is in a 3 o'clock position on the first roller 54, the feed member 60 is in most-backed state.

When the first rollers 54 are rotated to cause the eccentric rotary members 58 to be turned around the centers thereof toward a 9 o'clock position thereon, the feed member 60 advances forward gradually. During this time, the tip portions 68 of the claws 64 urge the envelope 12 forward to hit the same on the stopper 30 shown in FIG. 1. Such forward and backward movements of the feed member 60 are repeated at a stroke which is as twice as large as the quantity of deviation of the eccentric rotary members 58.

During this time, the second rollers 56 which are supported independently of the first rollers 54 and pressed by the spring 80 as mentioned previously press the foremost envelope 12 firmly against the surface of the transfer conveyor 18, and cooperate with the feed member 60 in driving the foremost envelope 12 successively and reliably beneath the lowermost envelope 12 of the piled envelopes 12. Thus, a stack of a large number of envelopes to be suitably fed to a stream feeder type printer can be prepared.

The present invention is not limited to the above-described embodiment, and it may be expanded and modified in various ways.

What is claimed is:

1. An envelope feeder comprising a basic body which is suspended from a support shaft provided above a transfer conveyor for said envelope feeder, said support shaft extending along said transfer conveyor, a pair of first rollers fixed rotatably to both sides of a substantially central portion of said basic body and having eccentric rotary members at the side portions thereof, a feed member having a front and rear portion and engaged with the basic body so that said feed member can be reciprocatingly moved, said feed member having claws at free ends of a bifurcated portion thereof, and said feed member being engaged at the rear portion thereof with said eccentric rotary members, and a roller support member having at free ends of a bifurcated portion thereof a pair of second rollers disposed in parallel with said claws, fixed pivotably at a substantially central portion thereof to said basic body, and said roller support member being urged to constantly bias said second rollers toward a surface of said transfer conveyor by a spring provided at the rear end portion of said roller support member.

* * * * *